US005665033A

United States Patent [19]

Palmer

[11] Patent Number: 5,665,033

[45] Date of Patent: Sep. 9, 1997

[54] SKI SIMULATING EXERCISE MACHINE

[75] Inventor: Dennis D. Palmer, 491 Aspen La., Park City, Utah 84060

[73] Assignee: Dennis D. Palmer, Draper, Utah

[21] Appl. No.: 327,365

[22] Filed: Oct. 21, 1994

[51] Int. Cl.[6] ..... A63B 22/08; A63B 22/20

[52] U.S. Cl. ..... 482/71; 482/51

[58] Field of Search ..... 482/51, 70, 71, 482/52, 148, 111, 112, 145, 79, 146, 147

[56] References Cited

U.S. PATENT DOCUMENTS

| | | | |
|---|---|---|---|
| 3,566,861 | 3/1971 | Weiss | 128/25 |
| 3,659,842 | 5/1972 | Aijala . | |
| 3,756,595 | 9/1973 | Hague | 482/51 |
| 3,787,047 | 1/1974 | Brawn . | |
| 4,396,189 | 8/1983 | Jenkins | 482/71 |
| 4,563,001 | 1/1986 | Terands | 272/72 |
| 4,595,195 | 6/1986 | Miehlich . | |
| 4,645,202 | 2/1987 | Tomba et al. . | |
| 4,669,723 | 6/1987 | Arsenian . | |
| 4,846,463 | 7/1989 | Kleinnibbelink . | |
| 5,004,224 | 4/1991 | Wang | 272/70 |
| 5,074,550 | 12/1991 | Sloan | 272/130 |
| 5,188,577 | 2/1993 | Young et al. | 482/53 |
| 5,284,460 | 2/1994 | Miller et al. | 482/51 |
| 5,318,488 | 6/1994 | Babcock | 482/51 |
| 5,391,130 | 2/1995 | Green | 482/51 |

OTHER PUBLICATIONS

Hammer Strength Brochure, dated Summer 1990.
Advertising brochure for Colombo Ski Master.

*Primary Examiner*—Stephen R. Crow
*Attorney, Agent, or Firm*—Terry M. Crellin; Robert Mallinckrodt

[57] ABSTRACT

An exercise machine that simulates the movements made during snow skiing to exercise the muscles used during such movements includes a pair of elongate foot support arms with foot support portions mounted for simultaneous vertical and horizontal movement with the vertical movement having opposite orientations for the same direction of horizontal movement. Thus, as the foot support portions of the foot support arms move in the same horizontal direction to one side or the other, one foot support portion moves vertically upwardly while the other moves vertically downwardly so that such movement generally defines an X pattern. Movement of the foot support arms is preferably coordinated so that the arms move together in a desired manner with resistance to movement of the arms preferably being adjustable by a user of the machine to adjust the strenuousness of the exercise performed. The desired movement of the foot support portions of the foot support arms may be achieved by mounting each foot support arm for limited rotational movement about separate axis of rotation, each axis of rotation extending along the intersection of perpendicular planes. One plane for each axis of rotation is substantially perpendicular to a machine central plane, with the other planes of each axis of rotation intersecting one another. Upper body supports or handles may be provided which, if desired, can provide upper body exercise in addition to support.

11 Claims, 5 Drawing Sheets

SKI SIMULATING EXERCISE MACHINE

BACKGROUND OF THE INVENTION

1. Field

The invention is in the field of exercise machines, particularly stair stepping machines and machines which simulate movements made during snow skiing.

2. State of the Art

There are numerous stair stepping or climbing machines which provide foot treads on which a user stands and which then move vertically up and down to simulate a user climbing stairs. Various resistance means are used to adjust the resistance to movement of the treads to make the climb harder or easier, but all such machines provide only vertical tread movement with the treads generally moving in opposite vertical directions, i.e., one tread moving up while the other tread moves down. The vertical up and down movement, while simulating stair climbing and muscles used for stair climbing, does not exercise a variety of muscles and does not simulate skiing movements.

Conditioning is important for sports like alpine snow skiing since injuries are more likely to occur if a participant is not conditioned for the strenuous activity that occurs during skiing. Further, special muscles are used during skiing which are not necessarily exercised during conventional exercise programs or on many exercise machines such as stair steppers. Thus, a number of machines for simulating movements made during alpine snow skiing have been developed for use in training for skiing activities. Most of these machines include foot treads that move back and forth, some moving back and forth laterally in a plane with others moving back and forth in an arc. For example, U.S. Pat. No. 3,659,842 shows a pair of cantilever arms, each having a foot support and each pivotally secured to a base for lateral movement with respect to the pivot mounts. The arms are bent upwardly to provide a forwardly inclined position to the user and the pivots may be angled in parallel planes extending front to rear of the frame to angle the arms and foot supports as they pivot.

As another example, U.S. Pat. No. 4,846,463 shows a single arm pivotally secured to a base with a single platform mounted thereon to simultaneously support both feet of a user. The pivot axis of the arm is angled in a central plane from front to rear of the base so as the arm rotates or pivots, the platform travels in an arc with the low point of the arc at the center of its swing.

Most of the various exercise machines that attempt to simulate the action of skiing include foot treads that move similarly in angular and vertical displacement as they move from side to side. This however does not represent the movements encountered much of the time during skiing.

SUMMARY OF THE INVENTION

According to the invention, it has been found that effective simulation of skiing movements and exercise of the muscles used during skiing for preskiing conditioning or rehabilitation after injuries can be achieved with an exercise machine having a pair of foot treads that combine side-to-side lateral or horizontal movement with opposite up-down vertical movement of the treads. Thus, as the treads move laterally toward a side of the machine from a centered position where the treads are each at the same vertical height, the outside tread in the direction of lateral movement will move vertically downwardly while the inside tread will move vertically upwardly. This combines the opposite up-down tread movement of a stair stepping machine with the side-to-side movement of a ski simulation machine.

The combined vertical up and down and horizontal side-to-side movement of the treads is achieved in the presently preferred embodiment of the machine by mounting the treads or foot support arms for pivotal movement about separate axes that are angled in planes substantially perpendicular to a plane including the longitudinal (front to back) axis of the machine. Thus, an exercise machine of the invention includes a machine frame, generally with a base for supporting the machine on a surface, such as a floor. The base will generally be substantially symmetrical about a central axis and central plane which extends from front to rear of the machine. This central plane is also defined as the axis that extends centrally between the foot support arms when such arms are in an equilibrium position. Each foot support arm of a pair of elongate foot support arms with foot support treads is mounted to the frame for limited rotational or pivotal movement about a separate axis of rotation, each axis of rotation extending along the intersection of perpendicular planes, one plane for such axis of rotation being substantially perpendicular to the central plane of the machine and the other planes for each axis of rotation intersecting one another.

The axes of rotations will each generally extend at an angle of between 20° and 80° from horizontal in the planes perpendicular to the central plane and such planes may be either vertical or sloped rearwardly or forwardly from vertical. When the plane is vertical, the treads will move up and down as they move from side to side in an X pattern with the treads moving in substantially a straight line, while if the planes are sloped forwardly or rearwardly from vertical, the treads will still travel in a generally X pattern, but in slightly curved rather than straight lines. Each configuration may be preferred in certain circumstances. The amount of vertical travel of a tread for a given amount of lateral travel is determined by the angle of the axis in the perpendicular plane, while the amount of curve in the movement is determined by the angle of the plane.

It will usually be preferred to link the foot treads to coordinate their movement so that they move together from side-to-side i.e., movement of one tread to the side will cause movement of the other tread to the same side. Such linking may be achieved in various ways such as mechanical or hydraulic linking of the foot support arms. In the embodiments illustrated, a hydraulic cylinder and piston assembly extends from each of the foot support arms to the frame outwardly of the pivot axes so that as the foot support arms swing from side to side, one of the hydraulic cylinder and piston assemblies is contracting while the other is expanding to an equal extent. Hydraulic fluid flows from one hydraulic cylinder and piston assembly to the other. With such an arrangement, the resistance to movement of the treads may be easily adjusted by adjusting a flow restriction or valve in the hydraulic fluid line between the cylinder and piston assemblies to restrict the flow of hydraulic fluid between the assemblies.

It is also generally preferable to provide hand supports for a user of the exercise machine to hold on to during mounting and use of the machine. To more closely simulate skiing, the hand supports may take the form of upwardly extending poles which are grasped by the user. These poles will generally be pivotally mounted to the frame so they can be moved as the exercise takes place. The poles may move completely independently of one another, may be linked to synchronize movement of one pole with the other, or may be linked to synchronize movement of the poles with the foot treads. Such linking may be mechanical or hydraulic. Alternately, separate poles could be provided for a user during use of the machine with such poles being completely independent of the machine. If desired, the machine can be used without poles or upper body support of any kind.

THE DRAWINGS

The best modes presently contemplated for carrying out the invention are illustrated in the accompanying drawings, in which:

FIG. 1 is a perspective view of one embodiment of an exercise machine of the invention;

FIG. 2, a front elevation of the machine of FIG. 1;

FIG. 3, a left side elevation of the machine of FIG. 1;

FIG. 4, a top plan view of the machine of FIG.1;

FIG. 5, a rear elevation of the machine of FIG. 1;

FIG. 6, a fragmentary top plan view showing only the foot support arms and their pivotal mountings and showing a centered or equilibrium position in solid lines and a laterally and vertically displaced position in broken lines; FIG. 7, a perspective view of a second embodiment of an exercise machine of the invention; and FIG. 8, a diagram showing the movement of the foot support treads of the machine of FIG. 8.

DETAILED DESCRIPTION OF THE ILLUSTRATED EMBODIMENTS

Figure 1:
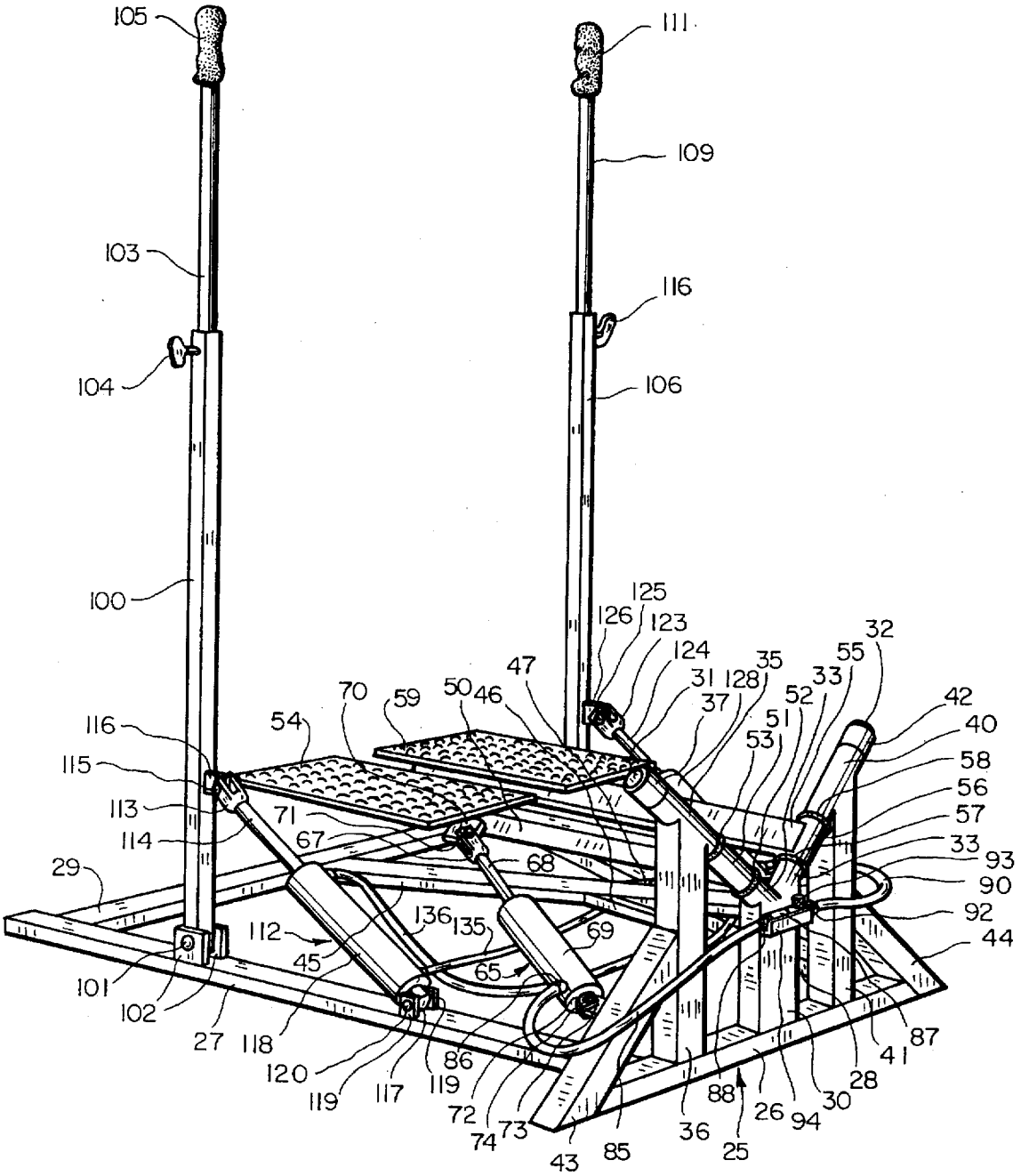
Figure 2:
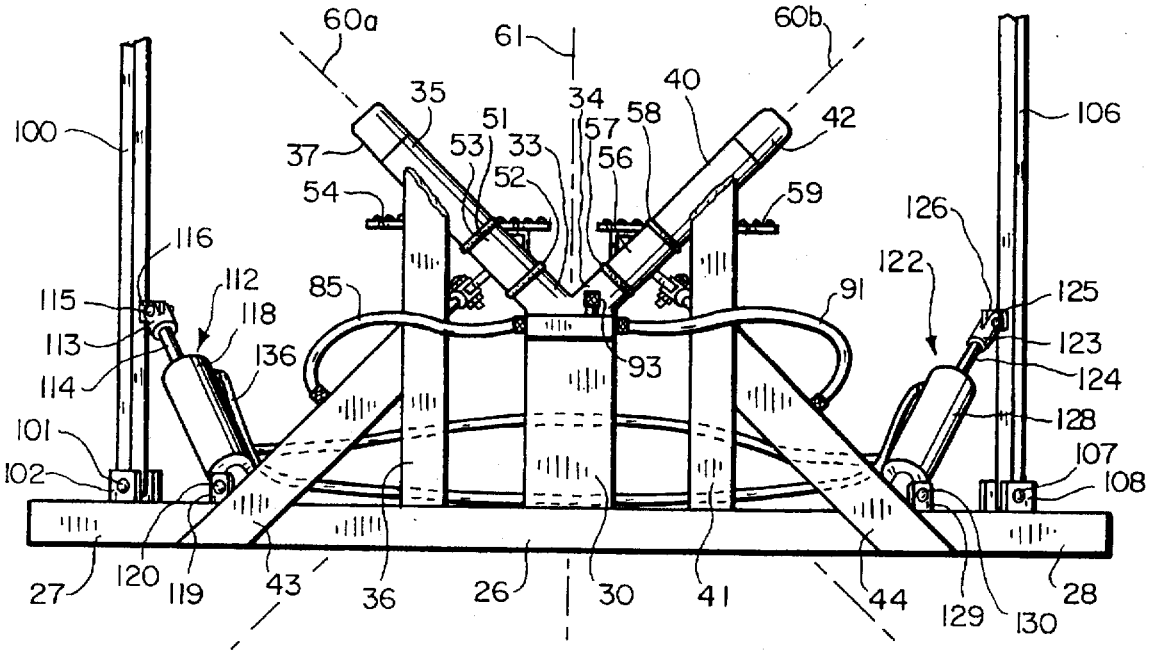
Figure 3:
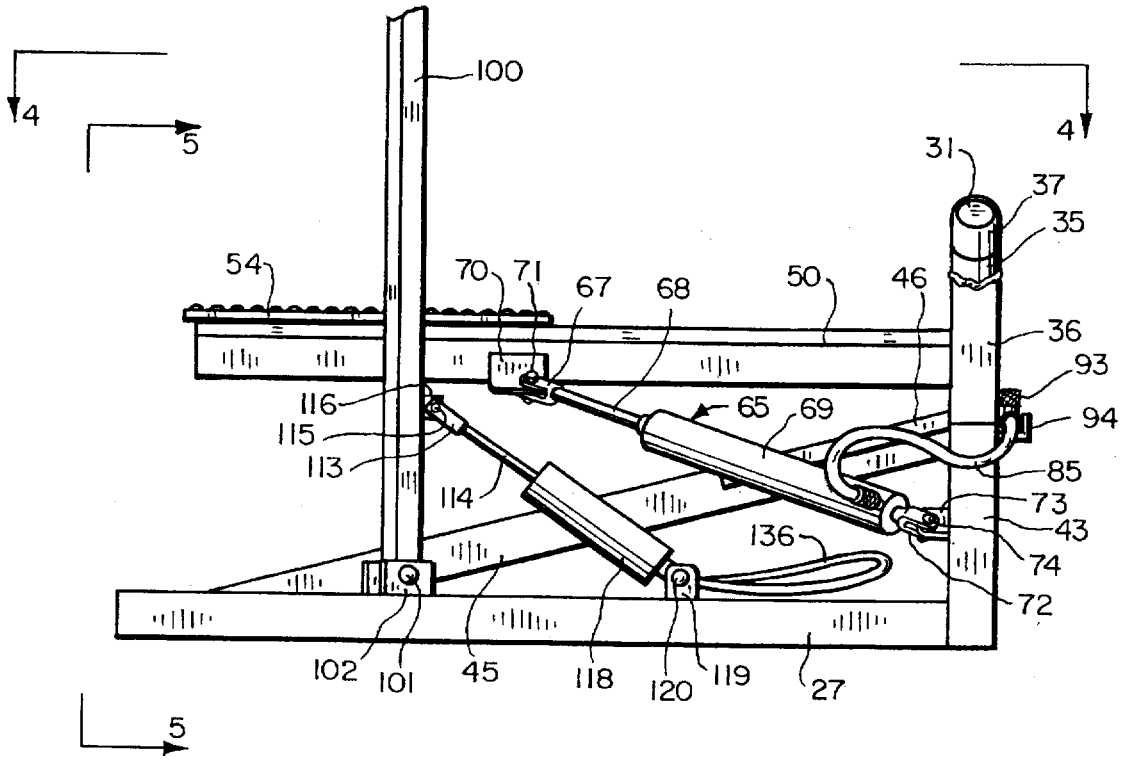

As shown in FIG. 1, an exercise machine of the invention includes a frame, generally 25, having a base with a front base member 26, side base members 27 and 28, and rear base member 29. A central vertical member 30 extends upwardly from front base member 26 and serves to anchor the lower ends of shafts 31 and 32 in tubular receiving members 33 and 34. Shaft 31 extends from tubular member 33 of the central vertical member 30 through tubular support member 35 supported by vertical member 36 secured to base member 26. The end of shaft 31 extends from support 35 and is capped by sleeve 37. Similarly, shaft 32 extends from tubular member 34 through tubular support member 40 secured to vertical member 41, with cap sleeve 42 on the end thereof. Braces 43 and 44 extend from the ends of front base member 26 to vertical members 36 and 41, respectively, brace 45 extends from central vertical member 30 to rear base member 29, and braces 46 and 47 extend from vertical members 36 and 41, respectively, to brace 45, all to reinforce the frame and make it rigid. It will be noted that the base is substantially symmetrical about a central axis and central plane that extends from the front to rear of the machine between front base member 26 and rear base member 29.

Elongate foot support arm 50, shown as a box beam, terminates at its front end in tubular member 51 which is positioned for rotation about shaft 31 between tubular receiving member 33 and tubular support member 35. Bearing washers 52 and 53 reduce friction as tubular member 51 moves with respect to members 33 and 35, respectively. A foot support tread 54 is secured to the rear portion of foot support arm 50 by bracket 54*a*, which angles the foot support tread 54 with respect to foot support arm 50 so that the tread is substantially horizontally flat when in a centered position as shown in FIGS. 1–5 and in solid lines in FIG. 6.

Similarly, elongate foot support arm 55 terminates at its front end in tubular member 56 which is positioned for rotation about shaft 32 between tubular receiving member 34 and tubular support member 40. Bearing washers 57 and 58 reduce friction as tubular member 56 moves with respect to members 34 and 40. A foot support tread 59 is secured to the rear portion of foot support arm 55 by bracket 59*a*.

Figure 4:
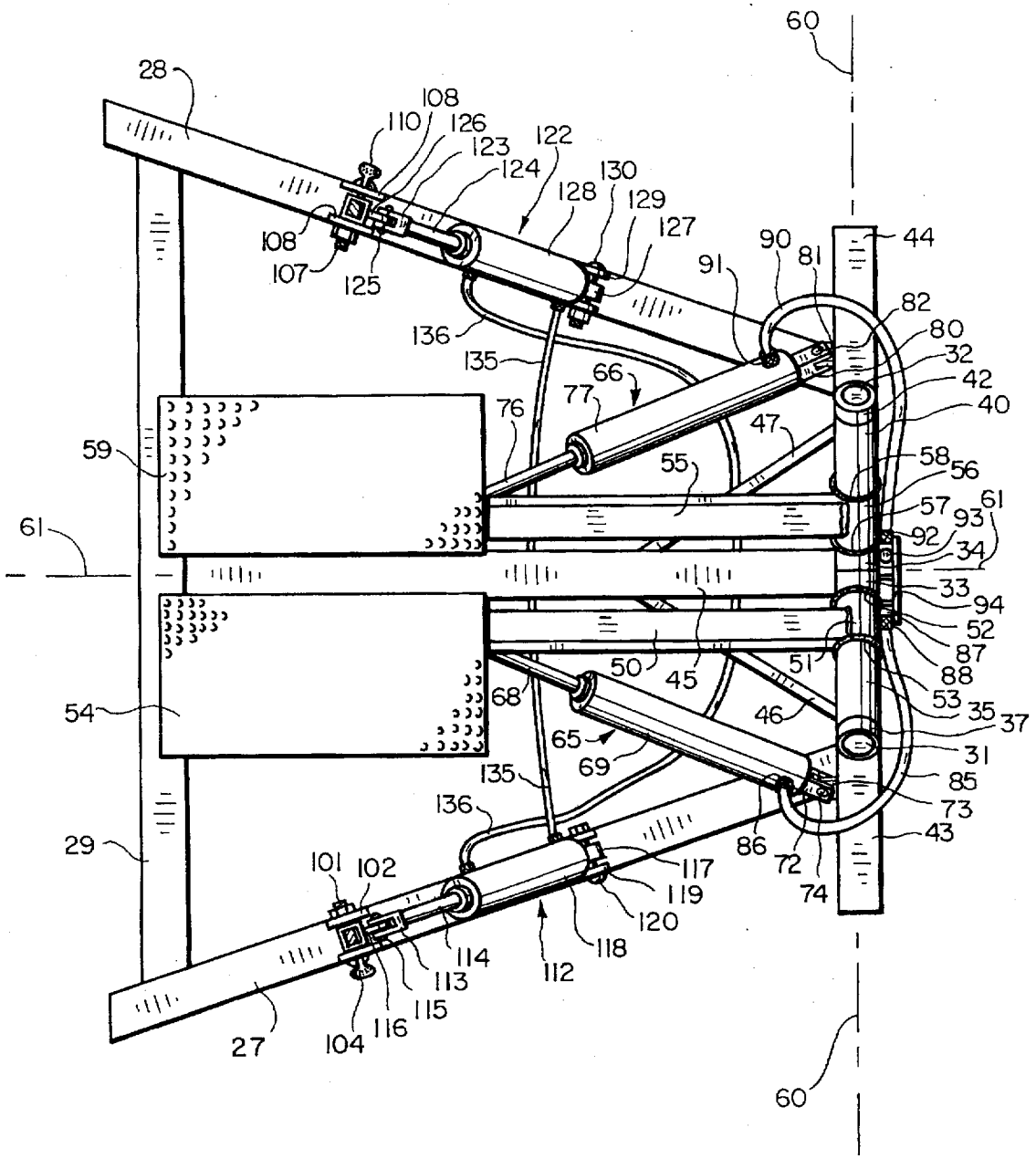

It should be noted that shaft 31, and thus the axis of rotation of foot support arm 50, extends along the intersection of perpendicular planes, one of which is indicated by line 60, FIG. 4, which is substantially perpendicular to the central plane of the machine, i.e., is in a plane which is substantially perpendicular to a central axis or plane, indicated by line 61, FIG. 4, which extends centrally from front to rear of the apparatus. The other of the perpendicular planes which define the axis of rotation along shaft 31 is indicated by line 60*a*, FIG. 2. Shaft 32, and thus the axis of rotation of foot support arm 55, extends along the intersection of perpendicular planes, one of which is also substantially perpendicular to the central plane of the machine. In the embodiments shown, such as in FIG. 4, this perpendicular plane is the same plane indicated by line 60. Thus, for the embodiments shown, the planes for each axis of rotation that are perpendicular to the central plane are a common plane. This, however, does not always have to be the case. For example, the axes could be arranged so one plane is behind the other or so that the planes can move with respect to one another. The other of the perpendicular planes which define the axis of rotation along shaft 32 is indicated by line 60*b*, FIG. 2. If a base as shown in FIGS. 1–6 is not present, or if the base for some reason is not symmetrical, the central axis and plane, line 61, can be defined as an axis or plane which extends between the foot support arms when they are in equilibrium position as shown in FIGS. 1–5 and solid lines in FIG. 6. Further, it should be noted that because shafts 31 and 32 extend at an angle to one another, the second plane of the perpendicular planes defining each axis of rotation, i.e., the plane indicated by line 60*a*, FIG. 2, for shaft 31 and by line 60*b* for shaft 32, will intersect. In the embodiments shown, where the planes perpendicular to the central plane are a common plane, the axes of rotation themselves will intersect in such common plane.

Figure 5:
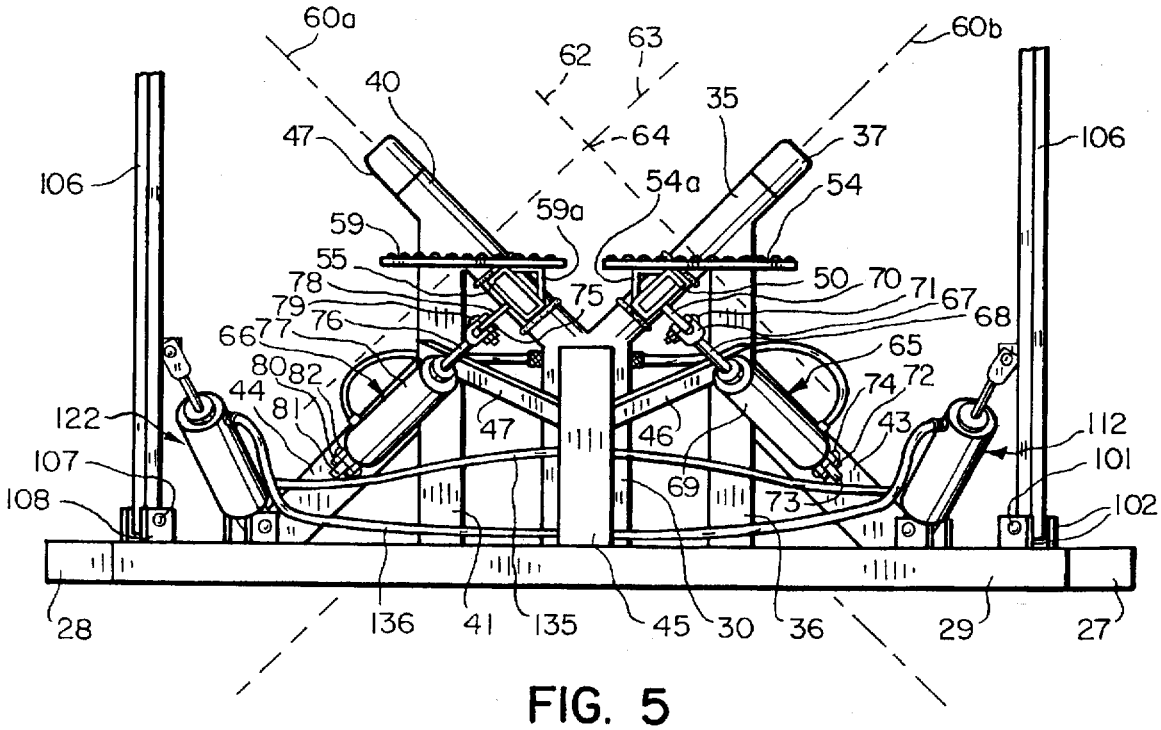
Figure 6:
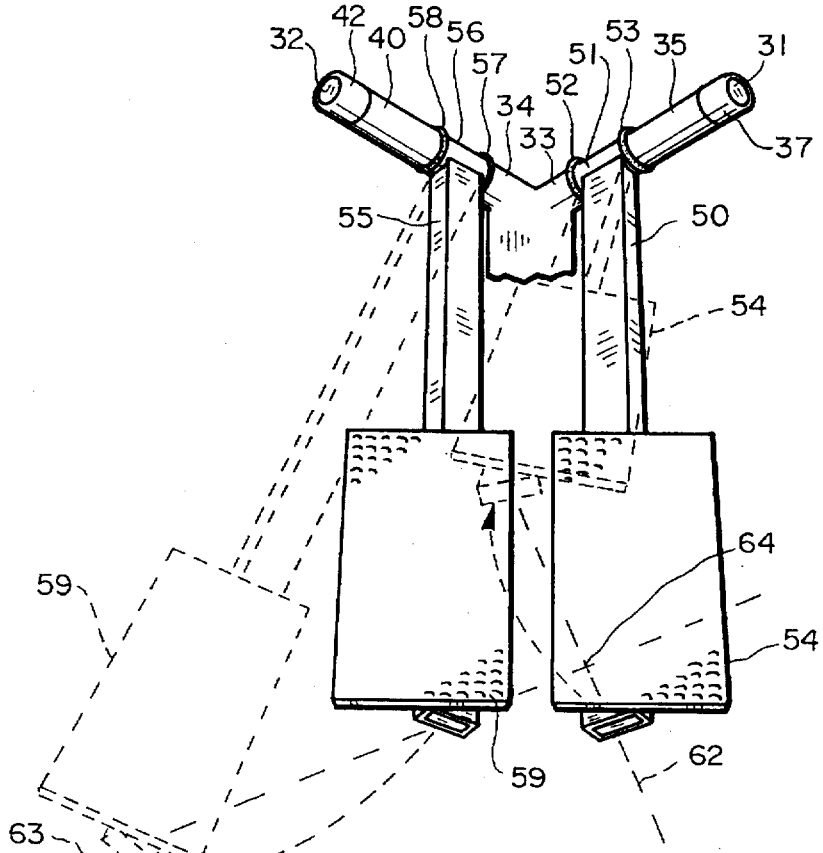

The shafts, axes of rotation, and thus the intersecting planes for each axis indicated by lines 60*a* and 60*b*, will generally be oriented at equal angles to horizontal. It should be noted, that, as shown in FIGS. 5 and 6, as foot support arms 50 and 55 rotate about shafts 31 and 32 when arranged as described, the foot treads 54 and 59 will move in diagonal lines 62 and 63 and that the path of such lines 62 and 63 will generally cross as at 64. Thus, each foot tread will move both vertically and horizontally and their movement will essentially describe an X formation. The axes of rotation for the foot support arms may be angled to various degrees, the degree of the angle determining the relative amount of vertical movement of the foot support treads to the lateral movement. It is currently preferred that the angles be somewhere between 20° and 80° with respect to horizontal, FIGS. 1–6 showing an angle of 45°. With an angle of 45° and the common plane or separate planes perpendicular to the central plane in which the axes are located being oriented vertically, the foot support treads will generally move equally in both horizontal and vertical directions as shown by lines 62 and 63 in FIG. 5. At greater angles to horizontal, the foot support treads will move less vertically for a given lateral movement while with lesser angles, the treads will move more vertically for a given lateral movement.

Movement of the foot support arms should be coordinated so that the arms will move together in a desired, coordinated fashion. The desired movement will generally be so that both foot treads move together to the same side, with one tread moving upwardly and one moving downwardly, as shown by the dotted arrows in FIG. 6. Various coordination means can be used. As shown for the embodiment of FIGS. 1–6, see particularly FIGS. 4 and 5, hydraulic cylinder and piston assembly 65 is connected between foot support arm 50 and front brace 43 while hydraulic cylinder and piston assembly 66 is connected between foot support arm 55 and front brace 44. To effect such securement, clevis 67 on the end of piston rod 68 extending from one end of hydraulic cylinder 69 of hydraulic cylinder and piston assembly 65, is pivotally connected to bracket 70 extending from foot support arm 50 under foot support tread 54 by pin 71. Clevis 72 extending from cylinder 69 at the opposite end is pivotally connected to bracket 73 extending from front brace 43 By pin 74. Similarly, clevis 75 on the end of piston rod 76 extending from one end of hydraulic cylinder 77 of hydraulic cylinder and piston assembly 66, is pivotally connected to bracket 78 extending from foot support arm 55 under foot support tread 59 by pin 79. Clevis 80 extending from cylinder 77 at the opposite end is pivotally connected to bracket 81 extending from front brace 44 by pin 82.

One end of hydraulic hose 85 is connected through hydraulic hose fitting 86 to the end portion of hydraulic cylinder 69 opposite that from which piston rod 68 extends and extends to connection at its opposite end to valve block 87 through hose fitting 88. One end of hydraulic hose 90 is connected through hydraulic hose fitting 91 to the end portion of hydraulic cylinder 77 opposite that from which piston rod 76 extends and extends to connection at its opposite end to valve block 87 through hydraulic hose fitting 92. A manually operable valve 93 can restrict flow of hydraulic fluid through valve block 87 to any desired degree.

With the arrangement shown, and referring to FIG. 4, as foot support tread 59 moves toward the top of the page and simultaneously into the page, i.e., it will move downwardly toward the base and to the left as shown by the broken arrow in FIG. 6 and downwardly and to the left along line 63 in FIG. 5, piston rod 76 is forced into cylinder 77 causing hydraulic fluid to be expelled from cylinder 77 and to pass through hose 91, valve block 87, and hose 85 into cylinder 69. This causes piston rod 68 to move outwardly from cylinder 69 causing foot support tread 54 to also move toward the top of the page and simultaneously out of the page in FIG. 4, i.e., upwardly and to the left as shown by the broken arrow in FIG. 6 and upwardly and to the left along line 62 in FIG. 5. Similarly, movement of foot support tread 54 toward the bottom of the page in FIG. 4 will cause piston rod 68 to move into cylinder 69 which causes hydraulic fluid to flow from cylinder 69 through hose 85, valve block 87, and hose 91 to cylinder 77. This causes piston rod 76 to move outwardly from cylinder 77 to move foot support tread 59 in the same lateral direction, i.e., toward the bottom of the page. In this way, movement of the foot support treads and foot support arms to which they are connected are coordinated and move together. One foot tread and associated foot support arm cannot be moved without that movement causing desired coordinated movement of the other foot support tread and associated foot support arm. Valve block 87 is held on vertical member 30 by bracket 94 so that valve 93 is operable by a user to adjust the restriction of fluid flow from one cylinder to the other. The restriction to fluid flow adjusts the resistance to movement exhibited by the foot support treads. Thus, if valve 93 is completely open, foot support treads 54 and 59 can move relatively easily from side to side with simultaneous up and down movement as described. As valve 93 is moved progressively toward closed condition, progressively more resistance to movement of the foot support treads is imposed. If valve 93 is completely closed, the foot support arms and foot support treads are locked in position and cannot be moved because fluid cannot flow between respective cylinders 69 and 77. The resistance to movement of the foot support treads determines the amount of effort required to move the treads and thus the degree of work and exercise obtained in using the machine.

The exercise machine of the invention may, if desired, be provided with upper body supports which may merely be support handles, may be separate ski pole-like devices which can be freely held and used, or may be upper body support or exercise devices in the form of poles extending from the machine base with movement coordinated with one-another or coordinated with the foot support treads. As shown in FIGS. 1–6, right pole support 100 is pivotally attached at one end by pin 101 to brackets 102 secured to base side member 27 intermediate its length. Right pole 103 is telescopically received in pole support 100 and secured at desired height by thumb screw 104 so that a user can easily hold right pole handle 105 while standing on the foot support treads. Similarly, left pole support 106 is pivotally attached at one end by pin 107 to brackets 108 secured to base side member 28 intermediate its length. Left pole 109 is telescopically received in pole support 106 and secured at desired height by thumb screw 110 so that a user can easily hold left pole handle 111.

A hydraulic piston and cylinder assembly 112 is connected between pole support 100 and base side member 27, with clevis 113 at the end of piston rod 114 pivotally connected by pin 115 to bracket 116 and cylinder end piece 117 extending from the end of cylinder 118 pivotally connected between brackets 119 by pin 120. Movement of pole 103 will cause movement of piston rod 114 either inwardly or outwardly with respect to cylinder 118. Similarly, a hydraulic piston and cylinder assembly 122 is connected between pole support 106 and base side member 28, with clevis 123 at the end of piston rod 124 pivotally connected by pin 125 to bracket 126 and cylinder end piece 127 extending from the end of cylinder 128 pivotally connected between brackets 129 by pin 130. Hydraulic fluid hose 135 connects respective ends of cylinders 118 and 128 while hydraulic fluid hose 136 connects opposite respective ends of cylinders 118 and 128. Thus, as pole 103 is moved forwardly forcing piston rod 114 into cylinder 118, fluid will flow from cylinder 118 through hose 135 into cylinder 128 while fluid will be drawn from cylinder 128 through hose 136 into cylinder 118. This will cause pole 109 to move rearwardly. With this arrangement, as one pole is moved forwardly, the other is moved rearwardly. Movement of the poles in this embodiment, while coordinated with one-another, is not coordinated with movement of the foot support treads. Such coordination, if any, comes from the user of the machine moving his or her arms in coordination with movement of his or her feet. If desired, fluid flow restriction means, such as a fluid valve, can be included in either hose 135 or 136 to provide adjustable resistance to movement of the poles. Also, if desired, hoses could merely extend from one end of a cylinder to the other so that the poles would move independently of one-another, with fluid flow through the hoses providing some desired resistance to movement.

Figures 7, 8:
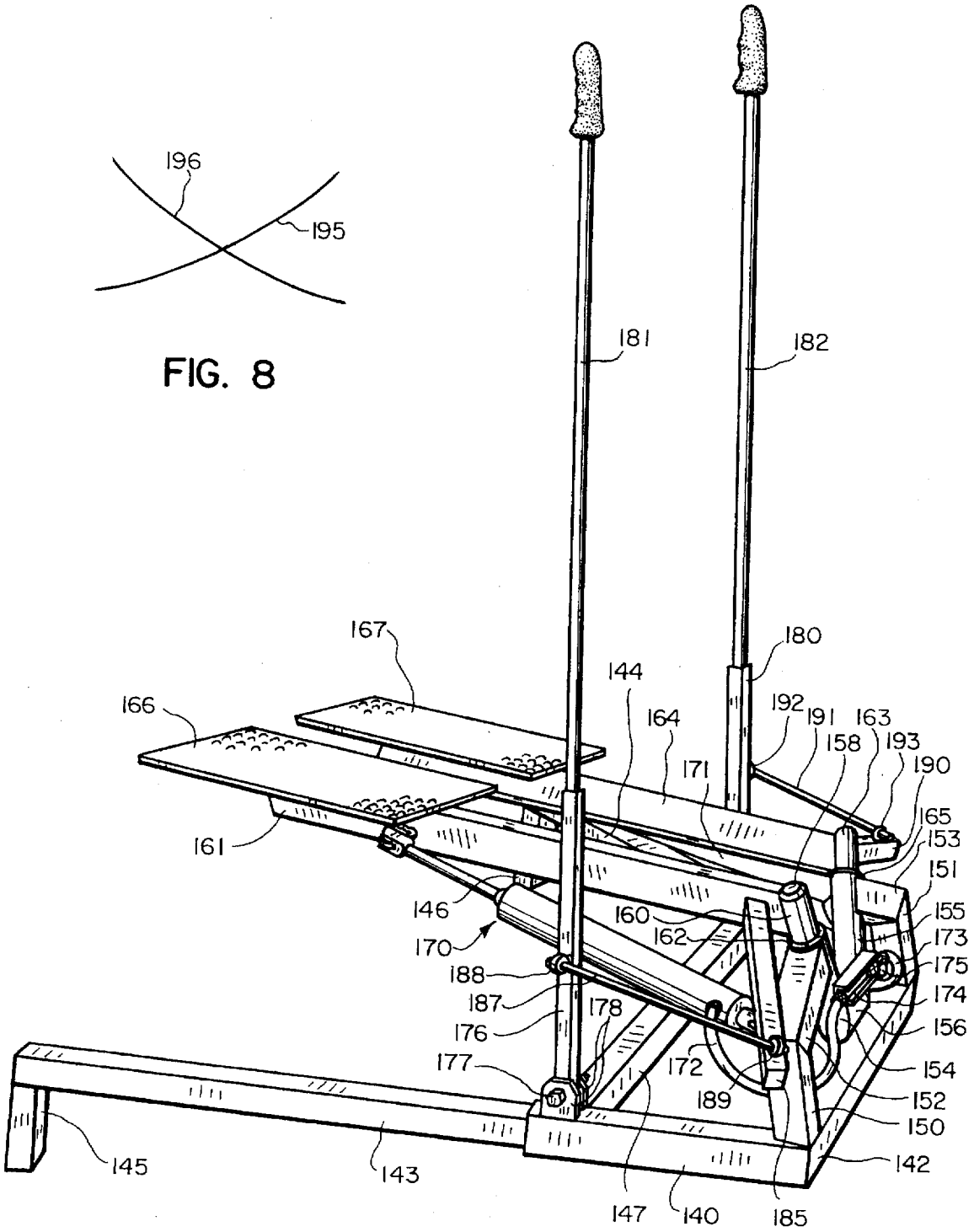

FIG. 7 shows a second embodiment of the exercise machine of the invention. As shown in FIG. 7, side base members 140 and 141 are secured to a front base member 142. Side extension 143 is telescopically received in side member 140 and extends therefrom, while side extension 144 is telescopically received in side member 141. Rear legs 145 and 146 extend downwardly from the rearward end portions of side extensions 143 and 144, respectively. Brace 147 extends between side members 140 and 142 for reinforcement. Again, the base is substantially symmetrical about a central axis and plane that extends from front to rear of the machine.

Forward upright members 150 and 151 extend upwardly, rearwardly, and inwardly from front base member 142 with extensions 152 and 153, respectively, extending inwardly therefrom to securement with the upper ends of shaft holding members 154 and 155 which are joined at their lower ends by member 156. Forward upright members 150 and 151, extensions 152 and 153, shaft holding members 154 and 155 and member 156 are all rigidly secured together such as by welding. Shaft 158 is received in and extends from shaft holding member 154, while a similar shaft, not visible in FIG. 7, is received in and extends from shaft holding member 155. Tubular member 160 at the forward end of foot support arm 161 fits rotatably around shaft 150 with bearing washer 162 between the bottom of tubular member 160 and the top of shaft holding member 154 so that foot support arm 161 can freely rotate on shaft 158.

Similarly, tubular member 163 at the forward end of foot support arm 164 fits rotatably around the shaft extending from shaft holding member 155 with bearing washer 165 between the bottom of tubular member 163 and the top of shaft holder 155 so that foot support arm 164 can freely rotate on the shaft. Foot support tread 166 is secured to the rear portion of foot support arm 161 and foot support tread 167 is secured to the rear portion of foot support arm 164. Hydraulic piston and cylinder assembly 170 is connected between foot support arm 161 and extension 152 while hydraulic piston and cylinder assembly 171 is connected between foot support arm 164 and extension 153. These hydraulic piston and cylinder assemblies are mounted similarly to hydraulic piston and cylinder assemblies 65 and 66 of the embodiment of FIGS. 1–6 and are similarly connected through hydraulic hoses 172 and 173 and valve block 174 with valve 175 to coordinate movement of the foot support arms and foot support treads similarly to that described in connection with FIGS. 1–6.

As with the embodiment of FIGS. 1–6, a right pole support 176 is pivotally connected to site member 140 by pin 177 extending between brackets 178. A similar arrangement, not shown, pivotally connects left pole support 180 to side member 141. Right and left poles 181 and 182 are received in pole supports 176 and 180, respectively. With the embodiment of FIG. 7, movement of the pole supports and poles are coordinated with movement of the foot support treads so that as the foot support treads move from side to side, the poles move back and forth. For this purpose, a right pole control arm 185 extends outwardly from the forward portion of foot support arm 161. A control rod 187 is connected at one end through ball joint 188 to pole support 176 and at the other end through ball joint 189 to right control arm 185 so that as foot support arm 161 rotates about shaft 158 so that foot support tread 166 moves from side-to-side (with simultaneous up and down vertical movement) pole support 176 and pole 181 move forwardly and rearwardly about pivot pin 177.

Similarly, a left pole control arm 190 extends outwardly from the forward portion of foot support arm 164. Control rod 191 is connected at one end through ball joint 192 to pole support 180 and at the other end through ball joint 193 to left control arm 190. This coordinates movement of left pole support 180 and left pole 182 with movement of foot tread 167.

An important difference between the embodiment of FIGS. 1–6 and the embodiment of FIG. 7 is that while the shafts 31 and 32 about which the foot support arms rotate in the embodiment of FIGS. 1–6 are in a plane which is substantially vertical, the shafts extending from shaft supports 154 and 155 about which the foot support arms rotate in the embodiment of FIG. 7 are in planes, here a common plane, which, while still substantially perpendicular to the central axis of the machine, is inclined to vertical, and, as shown in FIG. 7, slopes rearwardly from vertical. With this arrangement, rather than the foot support treads moving in the straight lines 62 and 63 as shown in FIGS. 5 and 6, the foot support treads move in the curved lines 195 and 196 shown generally in FIG. 8. The amount of the curve depends upon the angles involved. This movement still generally describes an X pattern.

The degree of rearward slope to the planes can be adjusted by adjusting the length of end legs 145 and 146. By making several lengths of these legs and making it so the legs are interchangeable, the user of the machine can adjust the slope of the planes and the curve in the movement of the foot support treads. It is currently preferred with such machine that the plane can slope as much as 25° rearwardly from vertical, with FIG. 8 showing the approximate curve with a rearward angle of 22.5° and outward angle of 67.5°.

While various features and combinations of features have been described for each of the embodiments shown, it should be realized that the various features can be combined in various other ways and combinations than as shown. Further, exercise machines can be made with less than all of the features described. The principal feature of the invention is the mounting of the foot support arms whereby the ends of the foot support arms away from their mounting and the foot treads mounted thereon move simultaneously both laterally and vertically and in substantially an X pattern.

Further, while the various embodiments shown all have bases to support the machine on a surface and the bases are shown as symmetrical about a central axis, in some instances a base may be provided that is not symmetrical about the central axis of the machine or which supports the foot support arms at their forward pivoted ends but does not extend rearwardly of such mountings. In such case, the central plane of the machine is a plane which extends between the foot support arms when such arms are in an equilibrium position.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. An exercise machine comprising:

a first pivot axis that extends outwardly and upwardly from a first side of vertical plane;

second pivot axis that extends outwardly and upwardly from a second side of said vertical plane;

a first elongate foot support arm mounted to said first pivot axis so that said first foot support arm extend from said first pivot axis and is adapted to pivot about said first pivot axis in a reciprocating, rotational movement about said first pivot axis;

a second elongate foot support arm mounted to said pivot axis so that said second, foot support arm extends from said second pivot axis and is adapted to pivot about said second pivot axis in a reciprocating, rotational movement about said second pivot axis;

foot receiving means on each of said first and second foot support arms for supporting a user's foot; and means for coordinating the movement each of the first and second foot support arms so that as said first foot support arm rotates clockwise about said first pivot axis, said second foot support arm rotates clockwise about said second pivot axis, and as first foot support arm rotates counterclockwise about said first pivot axis, said second foot support arm rotates counterclockwise about said second pivot axis, wherein said first and second foot support arms move in concert so that (1) as the foot receiving mean of the first foot the foot receiving means of the second foot support support arm moves upwardly and toward said vertical plane, arm moves downwardly and away from said vertical plane and (2) as the foot receiving means of the first foot support arm moves downwardly and away from said vertical plane, the foot receiving mean of the second foot support arm moves upwardly and toward said vertical plane.

2. An exercise machine according to claim 1, including means for coordinating movement of the foot support arms includes a hydraulic piston and cylinder assembly associated with each of the foot support arms, and hydraulic fluid flow means connecting the cylinders of the hydraulic piston and cylinder assemblies to allow hydraulic fluid to flow between respective cylinders to coordinate movement of each hydraulic piston and cylinder assembly.

3. An exercise machine according to claim 2, wherein each hydraulic piston and cylinder assembly is connected between its associated foot support arm and a machine frame.

4. An exercise machine according to claim 2, additionally including adjustable fluid flow restriction means associated with the hydraulic fluid flow means whereby the adjustable fluid flow restriction means can be adjusted to restrict fluid flow to a desired degree which resists movement of the foot support arms to a desired degree.

5. An exercise machine according to claim 1, including a machine base for supporting the machine on a surface, with the base being substantially symmetrical with said vertical plane.

6. An exericse machine according to claim 1, wherein said first pivot axis and said second pivot axis are in a common plane that is perpendicular to said vertical plane.

7. An exercise machine according to claim 6, wherein said common plane is substantially vertical.

8. An exercise machine according to claim 7, wherein each of said first pivot axis and said second pivot axis extends outwardly and upwardly from said vertical plane at a substantially equal angle to said vertical plane, with the substantially equal angle being in the range of between 20° and 80°.

9. An exercise machine according to claim 1, wherein said first pivot axis and said second pivot axis are in a common plane that is substantially perpendicular to said vertical plane, with said common plane making an angle to vertical.

10. An exercise machine according to claim 9, wherein the common plane makes an angle to vertical of up to 25°.

11. An exercise machine according to claim 9, including a machine base for supporting the machine on a surface, with means for adjustably angling the base supporting the machine on said surface so that the base member can be adjusted to a desired angle to vertical.

* * * * *

UNITED STATES PATENT AND TRADEMARK OFFICE

CERTIFICATE OF CORRECTION

PATENT NO : 5,665,033

DATED : Sept. 9, 1997

INVENTOR(S) : Dennis D. Palmer

It is certified that error appears in the above-identified patent and that said Letters Patent is hereby corrected as shown below:

Column 8, line 56, add --a-- before the word "second" at the beginning of the line; line 59, change "extend" to --extends--; and line 64, delete the comma after the word "second". Column 9, line 12, change "mean" to --means-- and change "foot the foot" at the end of the line to --foot support arm moves upwardly and toward said vertical plane, the foot--; line 13, change "support support arm" at the end of the line to --support arm--; and delete line 14 in its entirety.

Signed and Sealed this

Twenty-fifth Day of November, 1997

*Attest:*

Bruce Lehman

BRUCE LEHMAN

*Attesting Officer*

*Commissioner of Patents and Trademarks*